United States Patent [19]

Baker et al.

[11] 4,359,681

[45] Nov. 16, 1982

[54] ALTERNATING CURRENT POWER CONTROLLER WITH DC TRANSISTOR SWITCHING AND AN INTERNAL DC POWER SUPPLY

[75] Inventors: Donal E. Baker, American Township, Lima County; Kenneth C. Shuey, Cridersville, both of Ohio

[73] Assignee: Westinghouse Electric Corp., Pittsburgh, Pa.

[21] Appl. No.: 328,168

[22] Filed: Dec. 7, 1981

Related U.S. Application Data

[63] Continuation of Ser. No. 145,402, May 1, 1980, abandoned.

[51] Int. Cl.[3] ..... G05F 3/02

[52] U.S. Cl. ..... 323/320; 323/237

[58] Field of Search ..... 323/235-246, 323/271, 320-327; 307/252 P, 252 W, 257, 325; 361/100, 101

[56] References Cited

U.S. PATENT DOCUMENTS

| | | | |
|---|---|---|---|
| 2,866,909 | 12/1958 | Trousdale | 307/257 |
| 3,418,561 | 12/1968 | Feldman | 307/257 |
| 3,526,791 | 9/1970 | Codichini | 307/257 |
| 3,564,394 | 2/1971 | Opal et al. . | |
| 3,667,030 | 5/1972 | Gordon et al. | 307/133 |
| 3,668,434 | 6/1972 | Brunsberg | 323/324 |
| 3,795,531 | 3/1974 | Allington . | |
| 3,879,652 | 4/1975 | Billings | 307/297 |
| 4,277,811 | 7/1981 | Sato | 361/101 |

FOREIGN PATENT DOCUMENTS

| | | | |
|---|---|---|---|
| 1275749 | 5/1972 | United Kingdom | 323/321 |
| 1510644 | 5/1978 | United Kingdom . | |

OTHER PUBLICATIONS

Final Report Under Navy Contract N62269-7-4-C-0151, pp. 89-118, Mar. 1975.

*Primary Examiner*—William H. Beha, Jr.
*Attorney, Agent, or Firm*—G. H. Telfer

[57] ABSTRACT

An alternating current power controller is provided that employs DC transistor switching for subcycle switching capability and to eliminate problems associated with SCRs and furthermore provides internal elements for generating the required DC control power from the AC source whether the AC load is on or off.

4 Claims, 2 Drawing Figures

ALTERNATING CURRENT POWER CONTROLLER WITH DC TRANSISTOR SWITCHING AND AN INTERNAL DC POWER SUPPLY

This is a continuation of application Ser. No. 145,402, filed May 1, 1980.

This invention relates to power controllers for controlling the supply of power from an AC supply to a load.

Power controllers provide circuit breaker functions such as protection of the load and wiring from overload conditions and in addition provide on/off control of the conduction of the load circuit. In solid state electronic configurations, power controllers can be devised to provide for on/off control from a location remote from the load and associated with the load circuit by a low power control circuit, such power controllers being referred to as remote power controllers (RPCs). Present remote power controllers are available in two basic configurations respectively for AC and DC load circuits.

DC RPCs are normally implemented with transistors as the switching elements because of their low saturation voltage drop which provides high efficiency. Also, they have the ability to turn off in a DC application, which is not the case for SCRs, and have very fast response to applied fault conditions.

AC RPCs, however, are normally implemented with SCRs (silicon controlled rectifiers or thyristors) for the main switching elements for the reasons that SCRs are latching devices which require very little drive energy to sustain conduction even for overloads and hence provide high efficiency. In AC circuits, SCRs naturally commutate (turn themselves off) at zero current crossover which lessens electromagnetic interference.

The qualities of SCRs can become a detriment for overload or fault conditions in AC RPCs. If the SCR is on and carrying load current and a fault occurs, the conducting SCRs and the RPC cannot be turned off until natural commutation occurs at the next zero current crossover. This is due to the latching nature of the SCR and cannot be changed no matter how fast the overload trip logic operates. During the overload, the peak current is limited only by system capability such as generator and conductor size and could be thousands of amperes. The duration of such a fault current could be up to about 270 electrical degrees if the fault is applied early in the period of the AC cycle.

These qualities can, of course, be taken into account in selecting the SCRs for the power controller so that they have sufficient size and current rating. However, this has a major impact on the cost of the RPC so that the cost is essentially governed by the maximum half cycle surge current that is anticipated. For example, an AC RPC of a given rating such as two amperes for normal load current will cost substantially more if it is to be used in a system in which it might be subject to a short circuit current of 10,000 amperes rather than one used in a system where it will only be subject to a short circuit current of about 200 amperes.

In addition, the SCR size and cost for a given surge current rating will increase as the frequency of the AC power decreases. For example, the SCR cost and hence the cost of the RPC will be higher for a 60 Hz. system than it is for an otherwise similar RPC for a 400 Hz. system.

Efforts to minimize these drawbacks have generally been along the lines of using a current limiting resistor in series with the SCRs to keep the maximum fault currents to which the SCRs are subjected within reasonable levels. This makes the SCR to some degree independent of fault current capability and to a lesser degree the cost and size becomes somewhat independent of system frequency. Billings U.S. Pat. No. 3,879,652, Apr. 22, 1975, discloses an example of an AC solid state power controller using SCRs of the type in which current limiting resistors have been used in series with the SCRs to limit their maximum fault current.

It is desired to provide an AC RPC that is totally independent of system surge current levels and system frequency.

Another aspect of RPCs that has been addressed in the art has been to try to achieve an RPC that is operable in either an AC or a DC load circuit. Such apparatus has been proposed in "Power Controller Breadboard and Development Requirements", a final report under United States Department of the Navy Contract N62269-74-C-0151, by Perkins et al., March 1975. Two power switch configurations are proposed which use only transistors as the switching elements and which avoid the inherent drawbacks of SCRs. In one version, inverse/parallel switches are arranged so that, in operation on an AC system, there is half cycle independent control with some resulting complexity. This arrangement does not require any isolated supply of AC to DC power but it does incur high losses in resistors associated with each of the inverse/parallel switches and an increased DC offset voltage. An alternative and preferred version is presented in the report which has only a single switch configuration associated with the line through full wave rectifiers so that it operates effectively as a DC switch even when associated with an AC system. However, this configuration as disclosed requires an isolated power supply for the DC switch and incurs a higher voltage drop in the DC mode unless terminals are provide for bypassing part of the rectifier in DC operation.

The present invention came about as a result of efforts to provide an AC power controller without the problems associated with SCRs and hence using transistors as the primary power switches but in a configuration such that no isolated power supply is required. The result is an AC power controller with the intended performance while retaining the optional capability of utilization as a DC power controller with preferably separate terminals for such purpose.

In accordance with the present invention, an AC power controller is provided in which a DC power controller with a transistor switch is utilized as the switching element and contains the features applicable to power controllers for control and status implementation. The arrangement is such that the DC power input and DC power output terminals of the DC transistor switch or power controller are connected through rectifiers respectively to terminals for connection to the AC supply and the AC load. Furthermore, these terminals are associated with a filter that smooths the ripple resulting from the rectified AC in order to provide the necessary DC power supply for the internal DC power controller circuits. Hence, what is achieved is a transistorized power controller operable on AC, while retaining capability for operation on DC, without requiring any isolated power supply. It therefore represents a simplified yet effective circuit for the performance of the objectives of independence from surge current levels and system frequency.

PREFERRED EMBODIMENTS

Figure 1:
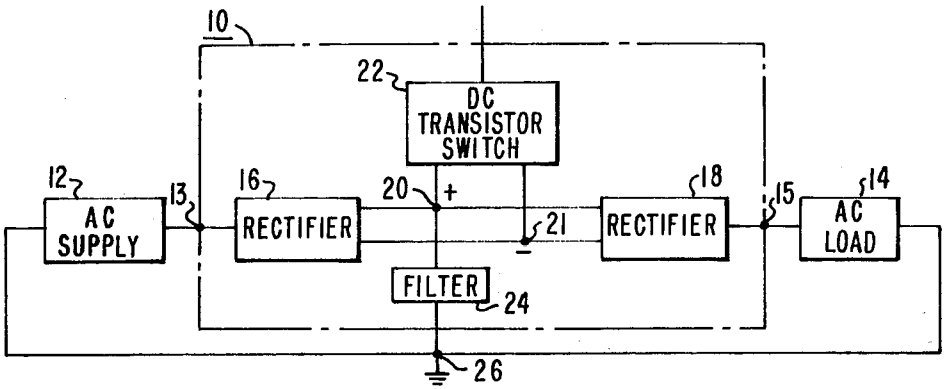
FIG. 1 is a generalized circuit schematic of an embodiment of the present invention.

FIG. 1 illustrates the basic building blocks of the present invention in a power controller 10 for controlling the supply of power from an AC supply 12 to an AC load 14 in which the AC supply terminal 13 and the AC load terminal 15 are each connected through rectifiers 16 and 18 for full wave rectification to the power terminals 20 and 21 of a DC transistor switch 22. The DC transistor switch preferably has associated with it the logic and control circuitry (not shown) of a DC power controller and may be implemented in accordance with known practice and will not be detailed herein. Examples of suitable DC power controllers are disclosed in a paper by D. A. Fox entitled, "Remote Power Controllers for the NASA Space Shuttle Orbiter" presented at the AIAA Conference of March, 1977, which is incorporated herein by reference. Such apparatus as is generally known provides a transistor switch for controlling the power in the load circuit in an arrangement such that the switch is responsive to applied signals to turn on or off the conductive path in the load circuit in response to inputs that may result from manual switch application or from the occurrence of faults in the load circuit.

The arrangement of FIG. 1 further illustrates a filter 24 connected between one of the input terminals 20 to the transistor switch 22 and the AC power ground 26. This filter 24 accomplishes the needs to the DC transistor switch as far as its power supply is concerned so that no isolated power supply is required.

In a sense, therefore, the present invention accomplishes its purpose in providing an improved AC RPC by utilizing a known type of transistorized DC RPC and modifying it by the rectifier and filter elements 16, 18 and 24 to provide AC operation.

Figure 2:
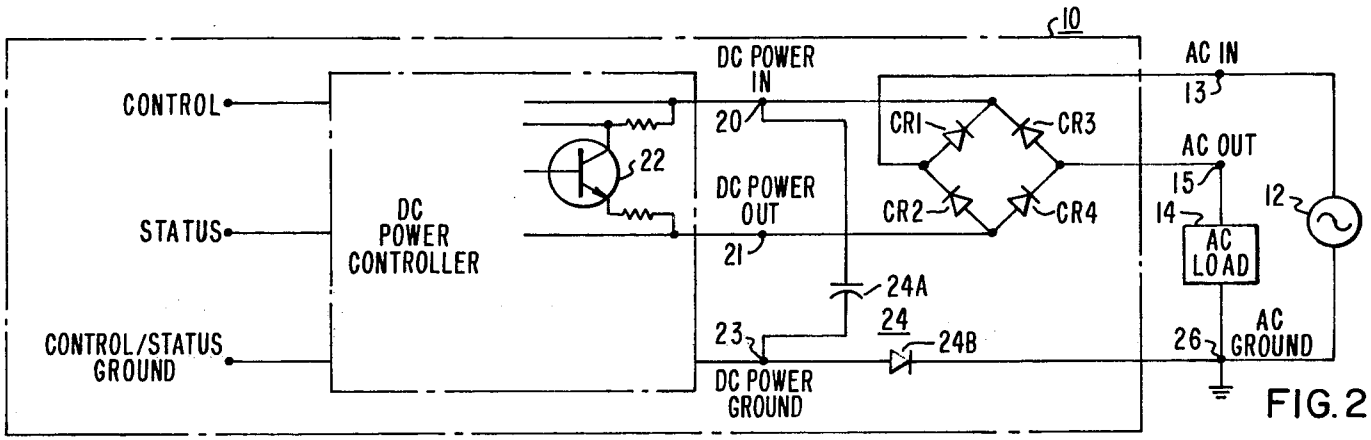
FIG. 2 is a further schematic diagram of an embodiment of the present invention.

Referring to FIG. 2, the rectifier diodes CR1 through CR4 convert the AC load current to DC which is applied to the DC RPC switch terminals 20 and 21. The AC input terminal 13 is connected through CR1 and CR2 respectively in the forward and reverse directions (corresponding to rectifier 16 of FIG. 1) to the respective DC power input and power output terminals 20 and 21. The AC output terminal 15 is connected through CR3 in the forward direction to the DC power input terminal 20 and through CR4 in the reverse direction to the DC power output terminal 21. The AC supply 12 and the AC load 14 have their other terminals connected in common to the AC ground point 26.

A filter 24 is connected between one of the DC terminals, here the plus or DC input terminal 20, to the AC ground 26 and comprises a capacitor 24A between the DC power input terminal and the DC power ground 23 and a diode rectifier 24B is connected from that point to the AC ground 26. This provides the filtered DC voltage for the control and drive circuits as required by the DC power controller and is discussed in the aforementioned Fox paper, for example. The achievement of this combination provides an RPC that can operate over a voltage range of from 25 to 200 volts. Therefore, the ripple voltage across the filter capacitor 24A can be quite high and thus the capacitor can be relatively small.

The switch voltage drop for this circuit at rated load is 2.7 volts which is comparable to an SCR RPC with a peak limiting resistor. Overall efficiency of the new circuit is also comparable to existing AC RPC designs. Unlike prior art AC power controller, such as that of the Billings patent, the cost and size of the RPC is independent of the required system surge current capability and system frequency since no SCRs are used and the switching is in the DC mode.

The circuit provides standardization of design so that one fundamental circuit, the DC power controller, can provide 25 to 200 volt DC RPCs and/or 115 to 230 volt AC RPCs. It is therefore possible to build one device which can be programmed by connecting external terminals to provide any of the above ratings.

As compared with other AC RPCs employing SCRs, this circuit avoids problems of having to provide capacitor voltage dividers, the problems of matching SCRs and the concern about their temperature ratings and the problems of selecting and matching other previously necessary components as those required herein may be readily provided without difficult matching problems.

In a typical DC RPC such as that of the described Fox paper, the inverse trip time delay characteristic is in the form of $$T_t = \frac{K(A - I_L)}{(I_L - B)},$$

where

A = instant trip current

B = ultimate trip current

K = time constant and $I_L$ = load current.

This can be shown to approximate a constant $I^2t$ relationship. As the load current $I_L$ approaches the instant trip current level A, the trip time, $T_t$, approaches zero or instant trip. In a typical 4,000 ampere surge system, this circuit can limit peak currents to two or three times the instant trip level due to the fast, instant, trip times of 1 to 10 microseconds.

It is therefore seen that a simple and effective AC RPC is provided that avoids the problems of the prior art. It will be understood that the invention may be practiced in various modified forms other than those specifically described or shown herein.

We claim:

1. A power controller suitable for controlling the supply of power from an AC supply to a load, while having the alternative capability of controlling the supply of power from a DC supply to a load, and comprising:

an AC power input terminal and an AC power output terminal;

rectifier means operatively connected between said AC power input terminal and said AC power output terminal for converting AC load current to rectified direct current supplied to a pair of DC supply terminals;

filter means connected between one of said DC supply terminals and a DC ground terminal for filtering said direct current from said rectifier means;

DC power controller means comprising a transistor switching circuit operatively connected between said pair of DC supply terminals;

said DC controller means also comprising control means connected to one of said DC supply terminals and to said DC ground terminal for generating signals to which said transistor switching circuit is responsive to control application of power between said AC power input terminal and said AC power output terminal, said control means being arranged to receive power, rectified to DC, from the AC supply independent of the on or off status of the load.

2. A power controller in accordance with claim 1 wherein:

said rectifier means comprises first, second, third and fourth diodes of which said first diode is connected in the forward direction from said AC power input terminal to a first of said DC supply terminals, said second diode is connected in the reverse direction from said AC power input terminal to a second of said DC supply terminals, said third diode is connected in the forward direction from said AC power output terminal to said first DC supply terminal, and said fourth diode is connected in the reverse direction from said AC power output terminal to said second DC supply terminal.

3. A power controller in accordance with either of claims 1 or 2 wherein:

an additional rectifier means is connected between said DC ground terminal and an AC ground terminal; and said power controller is adapted for connection in an AC load circuit by connecting said AC power input terminal to one side of an AC supply, connecting said AC power output terminal to one side of the load, and by connecting the other side of both of said supply and load in common to said AC ground terminal.

4. An AC power controller for controlling the supply of power from an AC supply to a load, and having the capability of ON/OFF switching of the power independent of the zero crossing of the AC waveform, comprising:

an AC supply terminal and an AC load terminal for connection of an AC supply and an AC load therebetween, and an AC ground terminal for common connection with the supply and load;

a DC transistor switch having input and output terminals both connected to said AC supply and AC load terminals with respective rectifier means therebetween, said switch being responsive to applied signals to turn on or off the conductive path between said AC supply and AC load terminals independent of the zero crossings of the AC waveform;

a filter connected between one of said DC input and output terminals and said AC ground terminal for providing sufficient filtered DC drive for said DC transistor switch without a separate power supply therefor, said filter comprising a capacitor connected between said one of said DC terminals and said DC ground terminal of said DC transistor switch and a diode rectifier connected between said DC ground terminal and said AC ground terminal; and control means for said DC transistor switch connected to said DC input terminal and said DC ground terminal for permitting operation of said DC transistor switch at any time the AC supply is connected to said AC supply terminal and said AC ground terminal.

* * * * *